United States Patent [19]

Patton

[11] 4,403,411

[45] Sep. 13, 1983

[54] METHOD OF FORMING PRECIOUS METAL ELECTRICAL CONTACT

[75] Inventor: George A. Patton, Candler, N.C.

[73] Assignee: Akzona Incorporated, Asheville, N.C.

[21] Appl. No.: 231,329

[22] Filed: Feb. 4, 1981

[51] Int. Cl.[3] ..... H01R 43/02

[52] U.S. Cl. ..... 29/879; 29/882; 204/15

[58] Field of Search ..... 29/876, 879, 885, 882; 204/46 G, 15; 428/672; 219/55; 339/256 R

[56] References Cited

U.S. PATENT DOCUMENTS

| | | | |
|---|---|---|---|
| 2,252,899 | 8/1941 | Reynolds | 29/882 X |
| 3,258,830 | 7/1966 | Pityo | 29/879 |
| 3,926,357 | 12/1975 | Matrisian | 29/876 X |
| 3,940,850 | 3/1976 | Rauenbuehler | 29/879 |
| 3,941,969 | 3/1976 | LeFever et al. | 29/882 X |
| 3,951,761 | 4/1976 | Bohringer et al. | 204/15 |
| 4,001,093 | 1/1977 | Koontz et al. | 204/15 |
| 4,069,109 | 1/1978 | Abei | 204/15 |
| 4,072,581 | 2/1978 | Allen | 204/15 |
| 4,089,106 | 5/1978 | Seidler | 29/879 |
| 4,278,520 | 7/1981 | Turner | 204/15 X |
| 4,342,498 | 8/1982 | Patton et al. | 339/259 R X |

*Primary Examiner*—Francis S. Husar
*Assistant Examiner*—Carl J. Arbes
*Attorney, Agent, or Firm*—Leydig, Voit, Osann, Mayer & Holt, Ltd.

[57] ABSTRACT

A precious metal electrical contact dot formed from a ribbon of base metal having one substantially flat side and one cylindrically rounded side has precious metal plated on the rounded side and a central ridge formed on the substantially flat side. A tab is formed by cutting a short length from the end of the ribbon, and the substantially flat side of the tab is resistance-welded to the wall of an electrical socket. The wall may be essentially copper, the base metal essentially nickel, and the precious metal essentially gold. A precious metal, gold, wash may be applied over the tab and adjacent wall surface.

1 Claim, 4 Drawing Figures

METHOD OF FORMING PRECIOUS METAL ELECTRICAL CONTACT

This invention relates generally to electrical contacts such as those of the pin and socket type and more particularly concerns placing a raised precious metal portion on a contact wall to insure good electrical conductivity.

Pin and socket electrical connections are commonly used in the communication and data processing industries. To insure a good electrical connection, it is common to form the socket with a raised precious metal, usually gold, projection to provide a non-corroding surface for firmly engaging a mating pin. This projection is often referred to as a gold dot. A typical specification for a quality connector socket will call for a dot of gold or gold alloy of a certain area, a certain thickness and hardness, and a certain resistance to being broken loose.

A commercial technique for forming a gold dot on a socket wall is to use very thin gold wire, about one mil in diameter, resistance weld the end of the wire to the socket wall surface, cut the wire to leave a short welded stub length on the surface, and then mechanically deforming or coining the stub into a mushroom-like dot. A technique of this general type is shown in Gannoe U.S. Pat. No. 3,392,575.

There are a number of inherent problems with this common technique of forming gold dots. The wire is so fine that it is very subject to breakage. The weld area is quite small, making the dot susceptible to being peeled up or sheared off. And since the socket material is normally a low electrical resistance copper alloy, it becomes difficult to resistance-weld low resistance gold to low resistance copper.

Other approaches to this same general objective are shown in the following U.S. Pat. Nos.: 3,475,816 Willoughby, 3,940,850 Rauenbuehler, 3,990,864 Rozmus, 4,025,143 Rozmus, 4,183,611 Casciotti et al.

It is the primary aim of the present invention to provide an improved gold dot forming technique that will more than meet requirements for gold area, thickness, hardness and mechanical strength, and yet is substantially less expensive.

More particularly, it is an object to provide such a technique that, compared to the gold wire procedure described above, produces a gold dot that is many times mechanically stronger, has superior electrical contact properties, and yet is only about one-half as expensive.

Other objects and advantages of the invention will become apparent upon reading the following detailed description and upon reference to the drawings, in which.

While the invention will be described in connection with a preferred embodiment and procedure, it will be understood that I do not intend to limit the invention to that embodiment or procedure. On the contrary, I intend to cover all alternatives, modifications and equivalents as may be included within the spirit and scope of the invention was defined by the appended claims.

Figure 1:
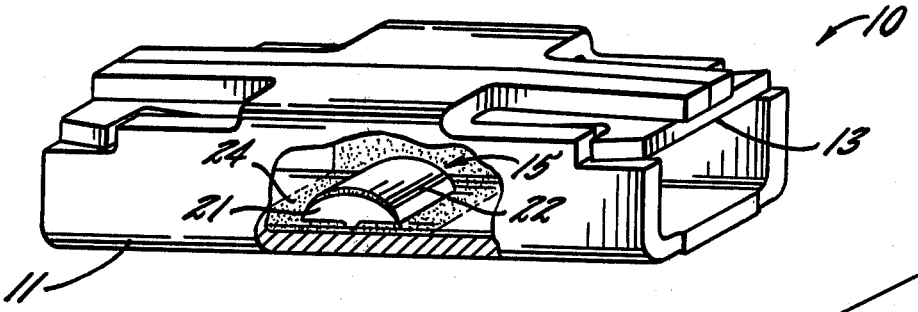
FIG. 1 is a perspective, with a portion broken away, of a completed electrical socket embodying the invention.
Figure 2:
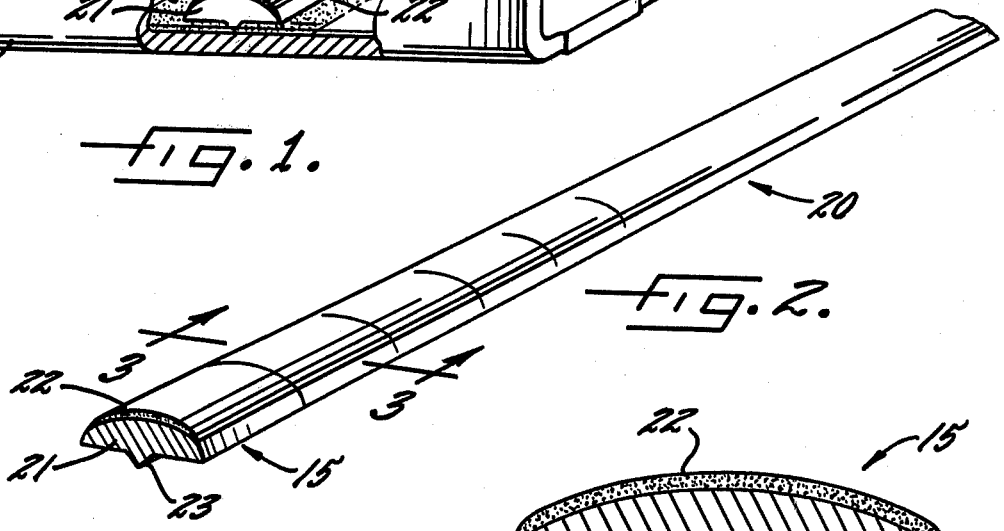
FIG. 2 is a perspective of the end portion of a ribbon from which gold dots of the present invention are formed.
Figure 3:
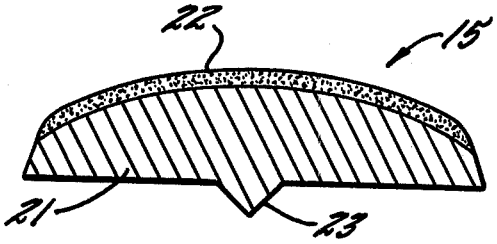
FIG. 3 is an enlarged section taken approximately along the line 3—3 of FIG. 2.
Figure 4:
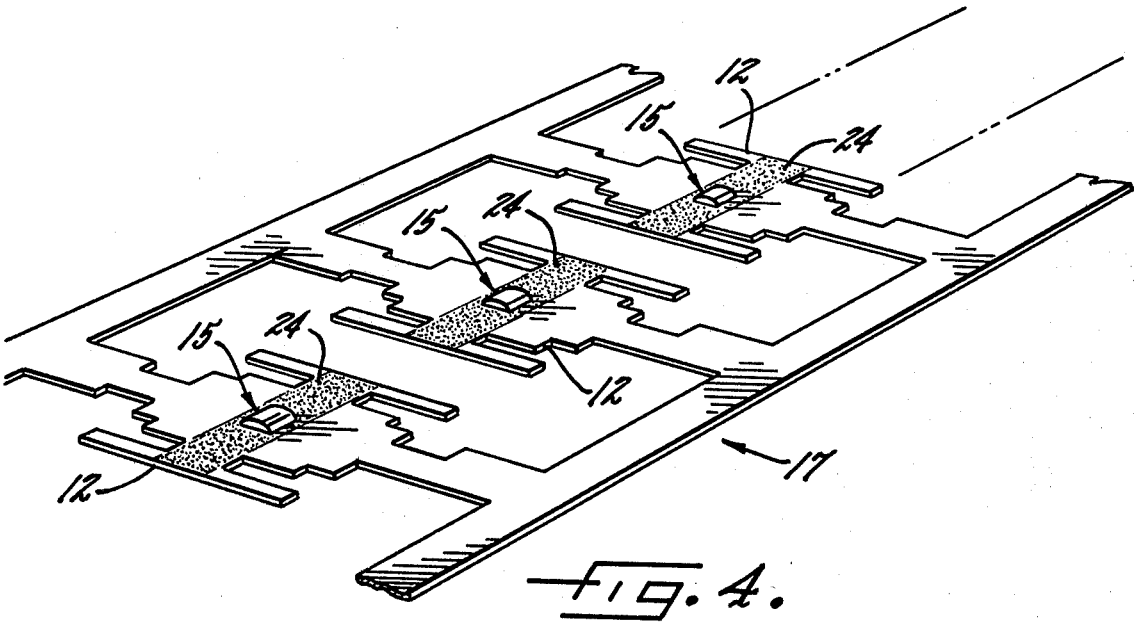
FIG. 4 is a fragmentary perspective of a strip embodying blanks from which the connector of FIG. 1 are made.

Turning now to the drawing, there is shown in FIG. 1 a completed socket box 10 comprising an elongated body 11 formed by folding a blank 12, a spring 13 mounted in the box, and a tab 15 embodying the invention and mounted on an internal socket wall 16 to form a gold dot. To give some idea of the scale involved in the exemplary embodiment, the box 10 is intended to cooperate with an inserted pin 0.025 inches square, and the illustrated tab 15 is approximately 0.03 inches square on the surface of the wall 16. The socket itself is described in some detail in U.S. Pat. No. 4,342,498 issued Aug. 3, 1982, and assigned to the assignee of the present invention.

The blanks 12 from which the socket 10 is formed are cut in a strip 17 and the tabs 15 are applied prior to folding, fitting in the spring 13, and trimming the socket 10 from the strip.

In accordance with the invention, the tab 15 is cut as a short length from the end of a carrier ribbon 20 formed of base metal 21 having one surface 22 plated with precious metal, and the base metal side of the tab 15 is resistance welded to the wall 16 of the socket box 10. Preferably, the ribbon base metal 21 has a substantially flat side formed with a central ridge 23, and the plated surface 22 is rounded from substantially side to side to form a generally cylindrical surface. The ridge 23 provides an initiation region for the resistance welding, and the tab 15 is disposed on the wall 16 so that the axis of the cylindrical plate surface 22 is at substantially right angles to the direction of pin insertion so as to provide line, instead of point, contact with a flat sided pin.

In the preferred embodiment, the socket box body 11 is formed of a copper alloy, the spring 13 is of a phosbronze alloy, the base metal 21 is essentially nickel, and the precious metal plated surface 22 essentially gold—either a gold alloy or pure gold can be used. In the illustrated example, the gold layer is plated to a minimum thickness of 0.001 inches. After welding on the tab 15, it is desirable to apply a thin gold wash 24 or flash over the tab 15 and surrounding portions of the wall 16 so that there is no base metal exposed. A wash layer 15 micro inches thick is satisfactory since only the thick plated surface 22 encounters mechanical wear.

The advantages of the invention can now be seen. The illustrated example only uses about 360 micrograms of gold or gold alloy, whereas the standard gold wire technique described above requires about 775 micrograms of gold per dot. The cost of gold is the major cost of the entire socket, and the invention cuts that gold cost in half. One reason only a thin gold plated layer is required is that nickel is an excellent barrier material for gold, preventing diffusion or intermetallic migration of the gold atoms. At the same time, nickel has relatively high electrical resistance so that the resistance welding to the copper wall is greatly facilitated.

Not only does the tab geometry give greater contact with a square pin than would a rounded dome dot, but the plated gold surface is virtually pore-free and dense, making for a superior electrical contact.

The mechanical strength holding the tab to the wall, because of the larger welded area as compared to the gold wire technique, results in a tear-away resistance found to be five to ten times greater. Thus, practicing the invention makes it virtually unnecessary to test each dot for mechanical strength.

It can thus be seen that there has been provided a gold dot type of electrical contact which is both superior to that obtained with the prior technique and which is substantially less expensive.

I claim as my invention:

1. The method of forming a precious metal electrical contact portion on that portion of a blank to be formed into an inner wall of an elongated copper pin-socket box comprising the steps of forming a tab by cutting a short link from the end of a carrier ribbon made of essentially nickel base metal having one surface plated with essentially gold precious metal, resistance welding the base metal to said portion of a blank to be formed into the interior copper wall through at least one ridge formed on the non-plated side of said tab, and coating the tab and surrounding portion of the blank to be formed into a wall area with a precious metal, essentially gold, wash so that no base metal is exposed.

* * * * *